US006400247B1

(12) United States Patent
King

(10) Patent No.: US 6,400,247 B1
(45) Date of Patent: Jun. 4, 2002

(54) MAGNET ENCLOSURE WITH DISPLAY

(76) Inventor: Feather King, 165 Reiten Dr., Ashland, OR (US) 97520

( * ) Notice: Subject to any disclaimer, the term of this patent is extended or adjusted under 35 U.S.C. 154(b) by 0 days.

(21) Appl. No.: 09/965,287

(22) Filed: Sep. 26, 2001

(51) Int. Cl.[7] ..... H01F 7/20; H01F 7/02; B65D 6/12; G09F 3/18

(52) U.S. Cl. ..... 335/302; 335/285; 40/312; 40/661; 40/661.01; 40/711; 40/732; 220/8

(58) Field of Search ..... 220/8, 23.87, 23.88, 220/23.89, 23.91; 40/312, 661, 661.01, 706, 707, 711, 722, 724, 729, 732; 335/285, 302, 303, 306

(56) References Cited

U.S. PATENT DOCUMENTS 4,509,656 A * 4/1985 Rosler ..... 220/8

5,154,292 A * 10/1992 Bartucca et al. ..... 206/39.3

* cited by examiner

*Primary Examiner*—Ramon M. Barrera
(74) *Attorney, Agent, or Firm*—Thomas M. Freiburger

(57) ABSTRACT

A container for a magnet, in the form of a box, has an outer clear plastic shell and an inner box preferably of opaque molded material, sized to fit closely within the clear outer shell. A magnet fits closely within the inner box. Between the outer and inner boxes, at an outer face of the composite container, a sheet of decorative or graphic material can be retained, sandwiched between walls of the outer and inner boxes. The inner and outer box elements preferably are retained together by snap-in structure, which in one preferred embodiment comprises nipples molded on the inside surface of side walls of the outer box, to be engaged in dimples or recesses at corresponding positions on the outer surface of the inner box's side walls. Both the inner and outer box elements are open at one side, and the magnet can be retained in the inner box by adhesives, fasteners or other appropriate connection devices.

8 Claims, 2 Drawing Sheets

MAGNET ENCLOSURE WITH DISPLAY

BACKGROUND OF THE INVENTION

The invention concerns magnets used for retaining items on metal surfaces and for display. More specifically the invention relates to an enclosure for a rectangular magnet with provision for displaying artwork, graphics or text from the enclosure.

A molded magnet enclosure for the type of magnet with which this invention is concerned is shown in U.S. Pat. No. 4,810,987. The enclosure of that patent was an elongated box in the shape of a rectangular solid, formed of a single piece, one small side of the box being formed as a door so that the magnet could be inserted lengthwise into the box. While this was effective to envelop and enclose the magnet, it had the disadvantage of placing a layer of plastic material between the magnet and the metal surface on which the magnet was to be placed, thus weakening the attractive power of the magnet.

Subsequently, magnets have been encased in five-sided rectangular enclosures of plastic, leaving one large rectangular face of the magnet not covered by the box. This exposed face has then been covered by a paper or plastic sticker with adhesive on one side, thereby allowing some form of text, graphic or pictorial display which could be observed when the magnet was not in use against a metal surface, but which would be hidden when the magnet was in use. The outer side of the box could have a design or graphic if desired, but this would generally have to be hot-stamped, silk-screened or pad printed onto the plastic box face or accomplished by some other form of add-on applied to the box exterior.

SUMMARY OF THE INVENTION

The invention described herein allows printed material to be secured between two layers of a magnet enclosure or cover. Two rectangular boxes are provided, an inner box fitting inside a clear outer box. Both boxes are open at one large side, so that a magnet can be contained in the interior of the inner box. Both the inner and outer boxes can be injection molded of a plastic material such as styrene.

Some form of snap-together device is preferably included between the boxes, so that when the inner box is forced into the outer box, a resistance is encountered until the inner box is substantially fully inserted in the outer box, at which point there is a snapping action at multiple locations coacting between the narrow side walls of the boxes. This may include some form of bump which passes over a ridge or into a depression, thereby effectively locking the two shells or boxes together. In one embodiment this snap-together means is a series of nipples or bumps on one side wall surface, and correspondingly-located recesses on the other surface, the nipples and recesses being on either of the outer box's inner side wall surfaces or the inner box's outer side wall surfaces. For example, three of these bumps or recesses can be provided in each of the elongated side walls which will become adjacent when the inner and outer boxes are snapped together.

This inner and outer shell arrangement permits a sheet of graphic material to be provided for display, to be placed between the large rectangular walls of the inner and outer boxes, thus visible from outside the clear shell of the outer box. Such a graphic can be sandwiched into the magnet case before the covered magnet is sold, such as for the advertising specialty business; alternatively, a graphic can be individually and personally created by a consumer if the magnet casing is sold in parts, prior to being snapped together, for the retail marketplace.

The magnet and casing could be round if desired, with a circular (or oval) display piece held between round outer and inner shells.

In a preferred embodiment the inner box is "reversible"; that is, it can be assembled into the outer box shell to form a closed box, and the snap-together devices will retain it closed. Thus, a magnet can be fully contained, by walls on all sides, if desired.

It is thus among the objects of the invention to provide a simple and effective construction for a magnet casing or enclosure, for efficiently holding a graphic or other display item at the outer surface of the casing, opposite the location of the magnet face. These and other objects, advantages and features of the invention will be apparent from the following description of a preferred embodiment, considered along with the accompanying drawings.

DESCRIPTION OF PREFERRED EMBODIMENTS

Figure 1:
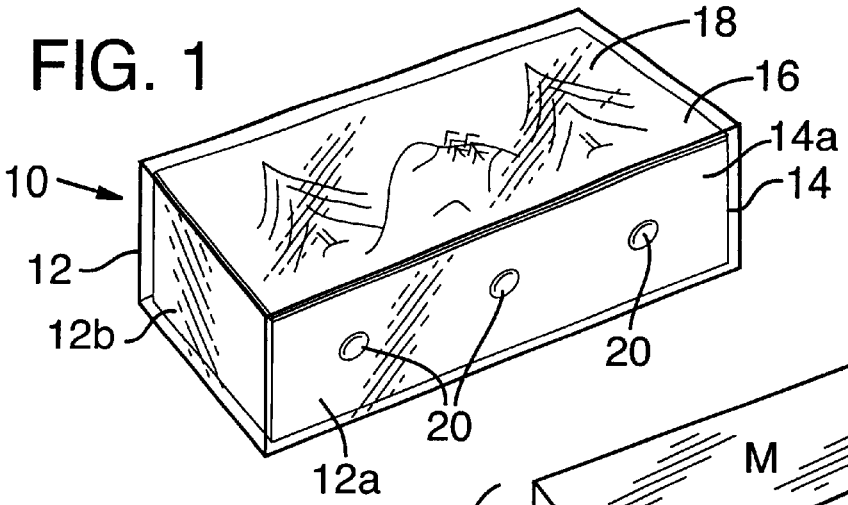
FIG. 1 is a perspective view showing a magnet casing according to the invention, displaying a graphic or picture.

FIG. 1 shows a magnet casing or enclosure 10 of the invention in assembled configuration. The magnet casing holds a magnet (not seen) within the shell-like casing 10, inserted from underneath and retained therein by appropriate securement such as adhesive, mechanical fasteners or tight fit. The casing includes an outer shell or box 12 which is transparent preferably throughout all five sides, and an inner shell or box 14 which is closely fitted within the outer shell 12 and the side surfaces of which are visible through the transparent outer shell 12.

As illustrated, the magnet casing 10 also includes a sheet of pictorial, graphic or text material 16 which is visible through the large face 18 of the outer shell 12. This sheet of material sandwiched between the large transparent face 18 and a corresponding large face of the inner shell 14 within, that face not being visible in FIG. 1.

FIG. 1 also shows one preferred means of retention of the two shells 12 and 14 together, namely, a series of bumps 20 and corresponding recesses which coact between the two shells. The recesses are not specifically seen in FIG. 1. The elongated side walls 12*a* and 14*a* of the outer and inner shells have these integrally molded nipples or bumps correspondingly-shaped recesses, and either the bumps or recesses can be included on either of the corresponding surfaces of the inner and outer shells. In a preferred embodiment the nipples are on the inside surfaces of the transparent outer shell's long side walls 12*a*, while the recesses are included on the outer surface of the inner shell's long side walls.

As mentioned above, the two shells in a preferred form can be snapped together with the inner shell 14 reversed, thus making a conventional box configuration for totally enclosing a magnet. The nipples and recesses (or other retention devices) are positioned to snap the shells together in either configuration. Both shells can be opaque, if desired, for use as a fully closed box.

Figure 2:
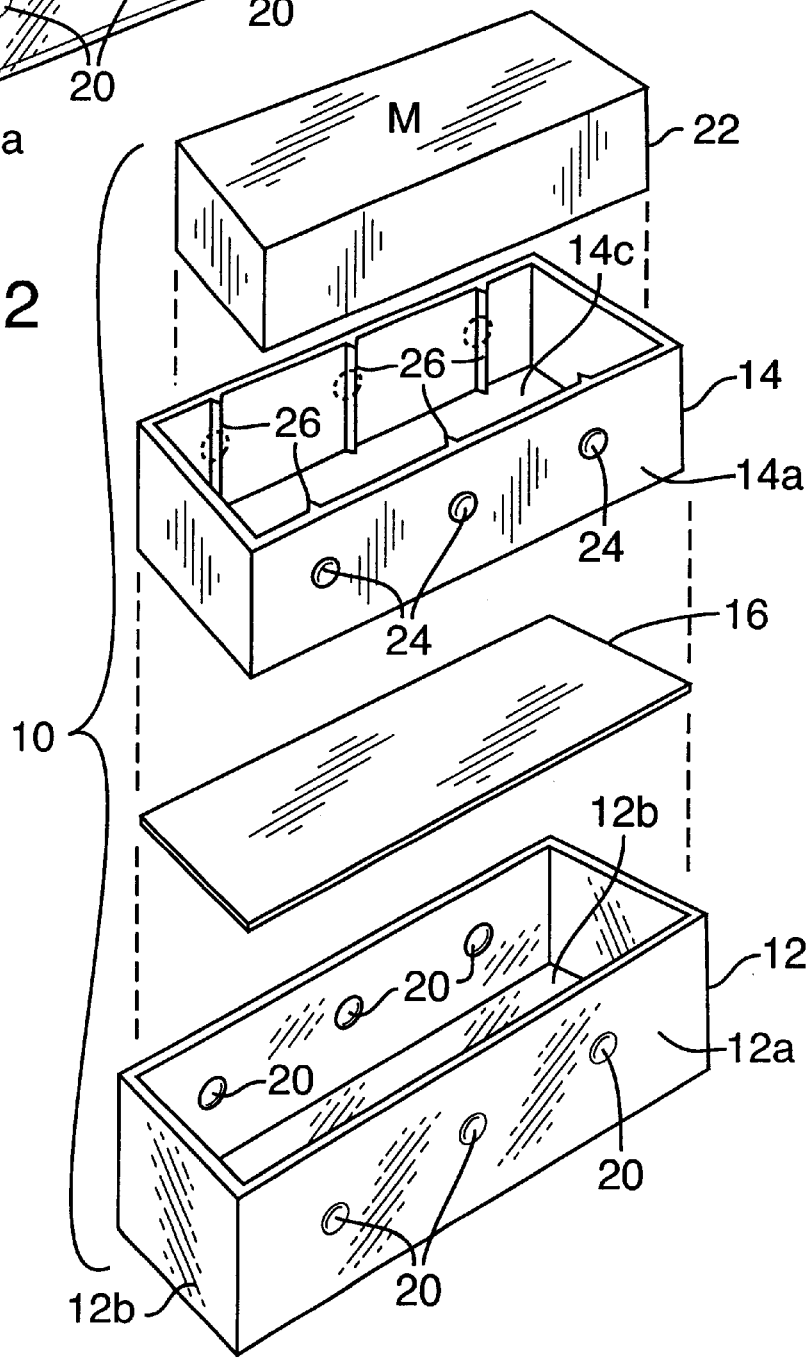
FIG. 2 is an exploded view showing two boxes or shells of the casing, prior to assembly together, and indicating a sheet of text, graphic or pictorial matter which is to be sandwiched between the two shell elements.

FIG. 2 indicates assembly of the inner and outer shells 14 and 12, the sheet of graphic material 16, and a magnet 22. The sheet of graphic or pictorial material 16 is sized to fit within the outer shell or box 12, as bounded by the long walls 12*a* and the short end walls 12*b*, with the pictorial material oriented downwardly as viewed in FIG. 2, so as to be visible through the transparent casing. The inner shell or box 14 is then placed into the outer shell, and forced inwardly until the bumps or nipples 20 snap into the recesses 24, which are correspondingly located. At this point the large face of the inner shell is substantially tight against the large face of the outer shell, with the thin sheet of material 16 between.

The magnet 22 is then inserted into the open sixth side of the inner shell 14. As noted above, the magnet can be secured therein by adhesives or by mechanical retention, such as by an appropriate form of fasteners or by a tight, interference fit within the inner shell 14. The gripping of the magnet in a tight fit can be enhanced by ridges 26 integrally formed on the inside surface of the inner box 14. The force-fitting of the magnet into the magnet housing or casing further increases the retention of the inner casing within the outer casing, via the snap-together elements 20, 24, since the walls of the inner casing are then permitted very little inward deflection.

Figure 3:
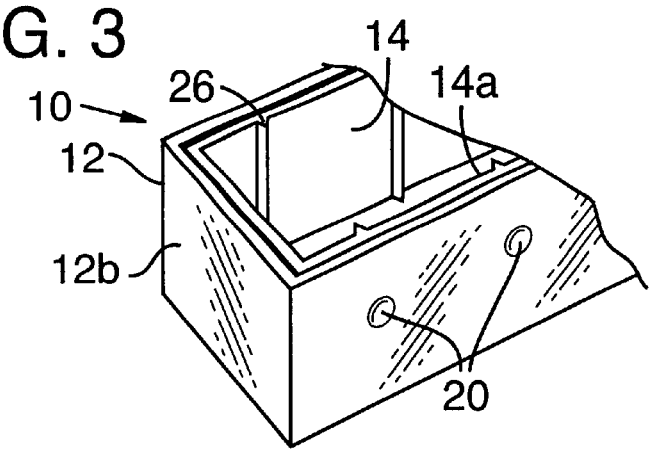
FIG. 3 is a partial view in detail and in perspective, showing one form of snap-together device for the box shells.
Figure 4:
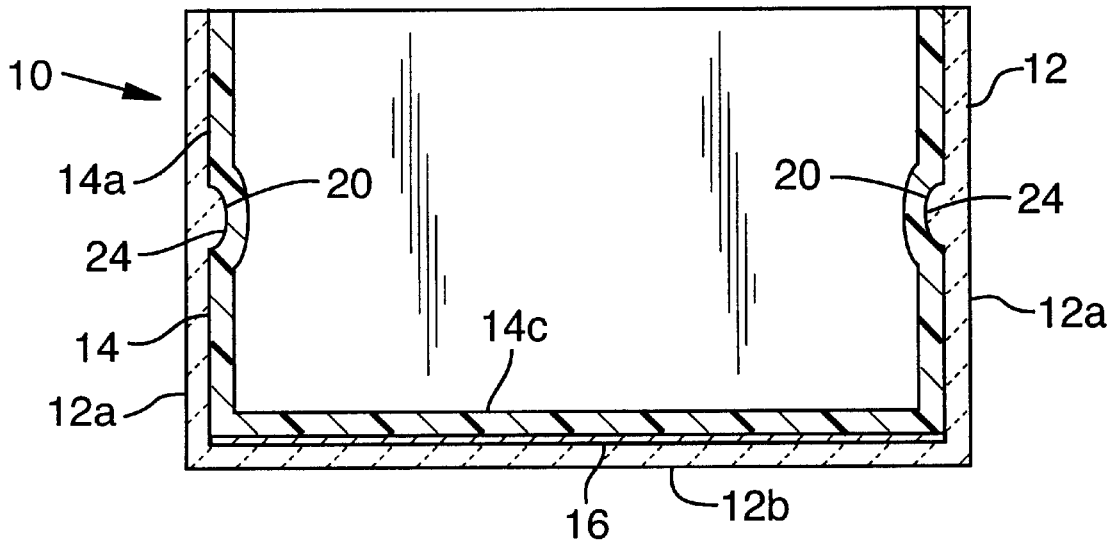
FIG. 4 is a sectional view of the assembled box shells, showing the snap-together device of FIG. 3.
Figure 5:
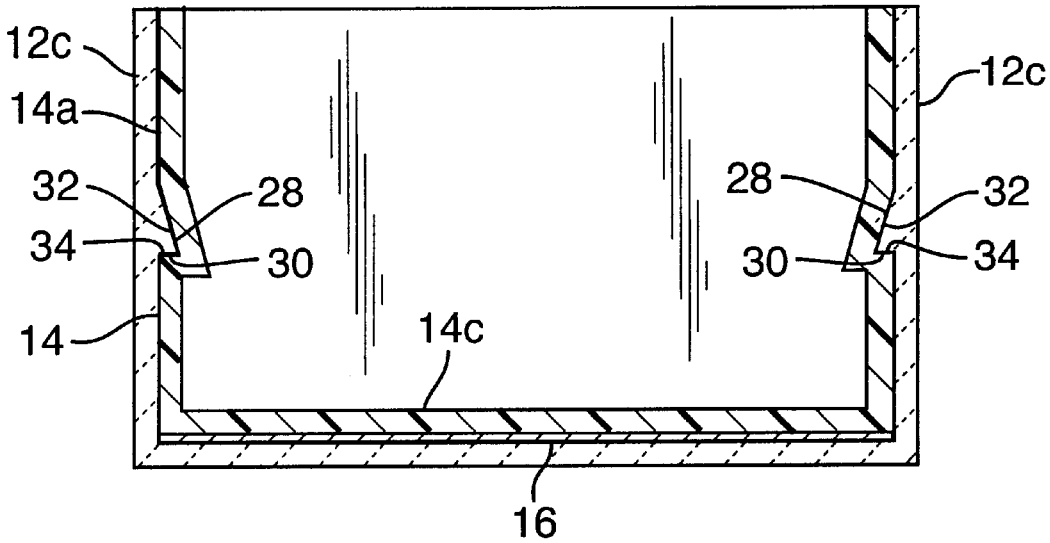
FIG. 5 is a view showing an alternative embodiment for snapping together of two box elements.

FIGS. 3, 4 and 5 show details of snap-together devices. FIGS. 3 and 4 show the nipples 20 as formed on the inside face of the transparent outer casing's long side wall 12*a*, the nipple 20 being visible because of the transparency of the outer shell but actually facing inwardly. The cross sectional view of FIG. 4 shows this more clearly, where the nipples 20 have nested within the recesses 24. Both the nipples and the recesses are integrally molded in their respective plastic shell elements. The sheet of graphic material is not seen in FIG. 4.

FIG. 5 shows an alternative form of snap-together device. Many different configurations can be used, the principle being that the inner shell element has to pass over a bump or ridge in the outer shell element until a feature of the inner shell passes the outer shell bump and allows the outer shell to spring back substantially to its undeformed configuration, locking the inner shell feature in place. In FIG. 5 the outer shell 12*c* has a rim 28 with a terminal ledge 30. The inner shell 14*c* has a corresponding structure including a recess 32 which may be inclined as shown, and a ledge member 34 which snaps under the outer shell ledge 30. The snap-together device could simply be a pair of corresponding ridges, one on the inner shell and one on the outer shell, the ridges being slightly rounded or tapered such that one ridge can snap under the other. In a further variation, the inner and outer shells could simply be secured together by adhesion or, in the case of compatible materials, by ultrasonic bonding. Even mechanical fasteners could be used, if desired, but the two shells preferably are held together by some appropriate form of snap-together device, particularly if the magnet and casing are to be sold to consumers in unassembled configuration, such that the consumer can put a graphic of choice between the shells.

Although a rectangular shape is shown, other shapes of magnet, casing and display can be used. One example is a round shape, circular, oval or elliptical. Retention of the shells can be by any of the means described.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A magnet and casing with a display, comprising:

a casing comprising inner and outer shells each having one open side, the inner shell being sized to fit within the outer shell by entry into the open side of the outer shell, and each of the shells having a flat outer side, the outer shell being of essentially transparent plastic material, retention means securing the inner shell within the outer shell, a display sheet of pictorial, graphic or text material sandwiched between the flat outer sides of the inner shell and the outer shell, and a magnet contained within the inner shell and having an exposed side at the open side of the inner shell.

2. The magnet and casing of claim 1, wherein the magnet and shells have shapes generally defining rectangular solids.

3. A magnet and a container for the magnet, whereby a rectangular solid magnet is essentially covered on five sides and exposed on one side, comprising:

an outer box element and an inner box element sized to fit closely within the outer box element, each box element being shaped generally as a rectangular solid with five closed sides and one open side, the inner box element having a magnet therein, the outer box element being of clear plastic so as to be essentially transparent, and including snap-fit retention means for securing the inner box element within the outer box element when the two box elements are pushed together, whereby a flat sheet of pictorial, graphic or text material can be sandwiched between the inner box element and the outer box element as the two box elements are assembled together, to display the sheet of material through the substantially transparent outer box element.

4. The magnet and container of claim 3, wherein the five closed sides of each of the outer box element and inner box element include one large side which is opposite the open side, and including a sheet of pictorial, graphic or text material sandwiched between the two box elements at said large side.

5. The magnet and container of claim 4, wherein the magnet is closely received within the inner box element, with one large face of the magnet exposed at the open side of the inner box element.

6. The magnet and container of claim 3, wherein the snap-fit retention means comprises a plurality of raised nipples coacting with a juxtaposed plurality of recesses, the nipples and recesses being located on adjacent side walls of one or the other of the inner box element and the outer box element.

7. The magnet and container of claim 6, wherein the outer box element has two elongated side walls, each having an inner surface with a plurality of integrally molded nipples facing inwardly, and the inner box element having a like pair of elongated side walls, each having a plurality of recesses facing outwardly and located at corresponding positions to the nipples of the outer box element.

8. The magnet container of claim 3, wherein the snap-fit retention means is configured to retain the two box elements together in either of two orientations: with the open sides facing one another, and with the open sides facing the same direction.

* * * * *